United States Patent [19]

Eventoff

[11] 4,314,228

[45] Feb. 2, 1982

[54] PRESSURE TRANSDUCER

[76] Inventor: Franklin N. Eventoff, 2351 Lake View Ave., Los Angeles, Calif. 90039

[21] Appl. No.: 140,937

[22] Filed: Apr. 16, 1980

[51] Int. Cl.[3] ..... H01C 10/10

[52] U.S. Cl. ..... 338/114; 84/1.14; 338/99

[58] Field of Search ..... 338/99, 69, 114, 42, 338/36; 357/26; 84/1.14, 1.15; 73/726, 727

[56] References Cited

U.S. PATENT DOCUMENTS

| | | | |
|---|---|---|---|
| 2,212,247 | 8/1940 | Randolph | 338/42 X |
| 2,474,662 | 6/1949 | Fuller | 338/42 |
| 3,093,806 | 6/1963 | Gutterman | 338/42 |

*Primary Examiner*—C. L. Albritton

*Attorney, Agent, or Firm*—Nilsson, Robbins, Dalgarn, Berliner, Carson & Wurst

[57] ABSTRACT

A pressure transducer device particularly useful in an electronic musical instrument includes a flexible base folded to define upper and lower flexible base portions, a donut-shaped first spacer between the upper and lower base portions and a resiliently deformable diaphragm attached about its periphery to the upper flexible base portion with a second donut-shaped spacer therebetween. A center region of the diaphragm laterally spaced from the second spacer is adhesively attached to a central region of the upper flexible base portion so that the upper flexible base portion moves inwardly and outwardly in response to the movement of the diaphragm. A pair of conductors are disposed on the folded flexible base member to face one another. A pressure responsive composition disposed over the conductors provides a contact resistance across the pair of conductors which varies inversely with the amount of pressure force exerted against the diaphragm. The upper flexible base portion may be attached between the first and second spacers about its entire periphery or at a small hinge region with the upper base portion being a flap movable about the hinge region in the region surrounded by the first spacer.

16 Claims, 6 Drawing Figures

PRESSURE TRANSDUCER

BACKGROUND OF THE INVENTION

The present invention relates to pressure transducer devices and in particular to a pressure transducer device with a contact resistance which varies in response to in a pressure force.

The present invention responds to a need for a low-cost, replaceable, simple and easily fabricated pressure transducer which can be used in any one of a number of applications but which can particularly be used in conjunction with a pressure actuated musical instrument such as an electronic saxaphone. In such an instrument it is desired to provide a mouthpiece into which a musician blows to cause variations in the amount of air pressure in a chamber to alter the volume of the tone generated by an electronic circuit. Thus, as the air pressure in the chamber is increased the volume will increase and vice versa. The musician will thereby have complete control of the volume of the tone or tones generated by the electronic circuitry of the musical instrument.

In order to achieve this result, it is necessary to provide a pressure transducer device which will be responsive to changes in pressure inside the chamber to cause variations in an electrical characteristic, such as a resistance, which is interconnected in the tone generating circuit.

In addition, a musician will be blowing into the chamber to cause increases and decreases in the pressure, certain amounts of moisture will enter the chamber and come in contact with a pressure transducer disposed therein. Hence, it is desired that the pressure transducer device be constructed so that it is not affected by such moisture in the chamber.

One possible pressure transducer device may be made by providing a first contact conductor on a flexible Mylar base, a second contact conductor on a second base material and a semiconducting composition disposed on one or both of the first and second contact conductors. The two contact conductors are then aligned in transverse, electrically spaced, relationship. In operation, as the flexible Mylar base is displaced, the two contact conductors with the semiconducting composition therebetween are brought into electrical conducting relationship. As the depression pressure increases the contact resistance through the semiconducting composition will decrease thus providing a pressure resistive transducer device.

While this device is suitable in some applications, it lacks sensitivity because of the inelastic nature of the flexible Mylar base material.

One possible way of increasing the sensitivity is to dispose the conductive and semiconductive material on a resilient stretchable membrane or diaphragm which provides positive action both when pressure is increased and when pressure is decreased. Such a diaphragm material could, for example, be dam rubber. However, one problem with such a device is that the conductor must expand and contract with the diaphragm in response to changes in pressure. This could eventually cause breaks in the conductor disposed on the diaphragm resulting in the failure of the pressure transducer device.

The present invention overcomes the problem of a lack of sensitivity when Mylar alone is used and yet is not subject to the conductor breaks caused by disposing the conductor on the diaphragm. Specifically, the pressure transducer in accordance with the invention provides a diaphragm adhesively attached about its peripheral edges to a spacer which is adhesively attached about the peripheral edges of a flexible Mylar member with a conductor disposed thereon. The diaphragm is then attached at a center location directly to the center of the Mylar member. When no pressure is applied to the diaphragm, the diaphragm positively pulls the flexible Mylar base away from a second base member because of its elastic characteristics. When a pressure is exerted against the diaphragm, the conductor on the flexible Mylar is forced into electrical conducting relationship with a second conductor on the second base member. The diaphragm thus imparts the positive action to the flexible Mylar. The flexible Mylar moves in response to the movement of the diaphragm.

In such an arrangement, it has been found that the sensitivity of the pressure transducer device in accordance with the invention is increased because of the aforedescribed positive movement of the diaphragm. Thus, the stretchable resilient characteristic of the diaphragm is imparted to the Mylar which does not have the desired resilient stretchable characteristics but which does provide a nonstretchable support member upon which the contact conductors can be disposed.

SUMMARY OF THE INVENTION

The present invention has a pressure transducer housing defining a chamber with a bottom surface and side walls, a first conductor affixed adjacent the bottom surface in the chamber, a flap member having an upper and lower surface generally parallel with the bottom surface, and a hinge region for movably attaching the flap to extend from a side wall into the chamber, the flap being movable in the chamber from the hinge region. A second conductor is affixed to the lower surface of the flap and a pressure responsive semiconducting composition layer disposed for covering at least one of the first conductors and the second conductors. A diaphragm is attached to the housing to provide a top closure surface of the chamber generally parallel but in spaced relationship to the bottom surface. The diaphragm is adhesively attached about its periphery to the housing. A central region of the diaphragm, laterally spaced from the housing, is adhesively attached to the upper surface of the flap whereby the second conductor is movable with the flap and the diaphragm into electrically conducting relationship with the first conductor in response to a pressure force exerted against the diaphragm.

The pressure transducer in accordance with the invention may further comprise a retaining member which is fixed to the diaphragm for holding the adhesively attached peripheral edges of the diaphragm against the housing. In addition, a rigid base member may be provided for maintaining the bottom surface of the chamber rigid as the pressure is exerted against the first conductor by the flap.

In one embodiment of the invention the first and second conductors may be disposed on a single piece of mylar which is folded along a fold line to bring the two conductors into facing but spaced apart relationship.

BRIEF DESCRIPTION OF THE DRAWINGS

A complete understanding of the present invention and of the above and other objects and advantages thereof may be gained from a consideration of the following description of the preferred embodiments taken in conjunction with the accompanying drawings in which.

DETAILED DESCRIPTION

Figure 1:
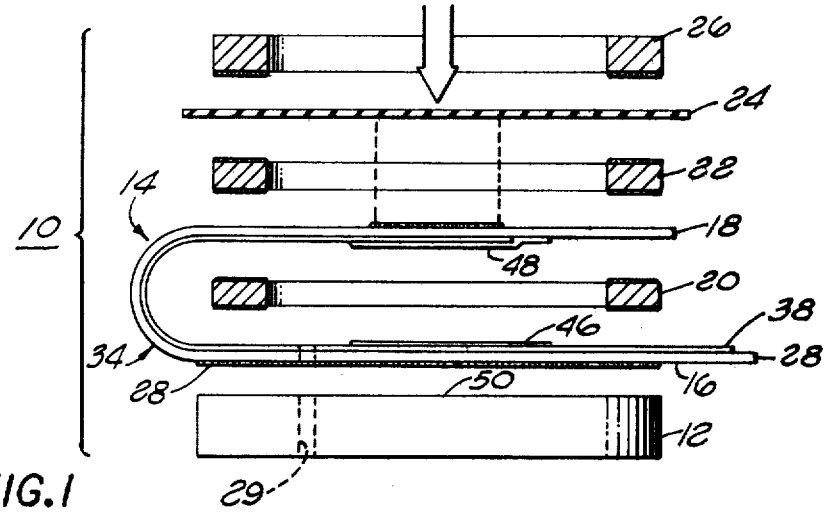
FIG. 1 is an exploded cross-sectional side view of one embodiment of a pressure transducer in accordance with the invention.

Referring first to FIG. 1 a pressure transducer device 10 in accordance with the invention has a rigid base member 12, a folded flexible base member 14 having a lower portion 16 and an upper portion 18, a diaphragm spacer 22, a resilient deformable diaphragm 24 and a retaining ring 26.

Figure 2:
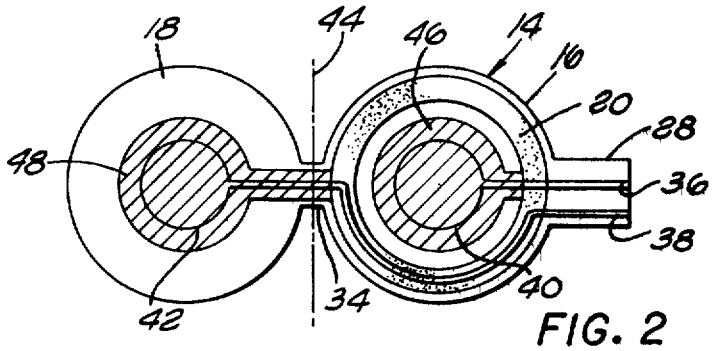
FIG. 2 is a top plan view of the flexible base member of FIG. 1 in an unfolded configuration showing the conductor patterns disposed thereon.

Referring more specifically to FIG. 2, the flexible base member 14 is illustrated in an unfolded configuration having a connector portion 28 extending from the lower circular portion 16 which is attached to the circular reciprocally shaped upper portion 18 by a bridge or hinge region 34. A first conductor 36 is disposed on the flexible base member 14 to extend from the connector portion 28 to define a contact pad 40 at a central region of the lower portion 16. A second conductor 38 is also disposed on the flexible base 14 commencing on the connector portion 28 and extending in a semicircular path around the periphery of the lower portion 16 across the hinge or bridge portion 34 and terminating at a central location in the upper portion 18 to define a contact pad 42. The first conductor 36 and the second conductor 38 are electrically insulated from one another along the surface of the flexible base member 14.

In the preferred embodiment, both the first conductor 36 and the second conductor 38 are very thin layers of silver which are disposed in selected regions on the surface of the flexible base by spraying, brushing or other similar techniques. Of course, the contact pads 40 and 42 and the upper and lower portions 16 and 18 may be of any desired shape without departing from the invention. However, both the contact pad 40 and the contact pad 42 must have a shape and must be positioned on the lower portion 16 and the upper portion 18, respectively, so that when the upper portion 18 is folded along a fold line 44, the contact pad 42 will be transversely aligned with the contact pad 40 to allow electrical conduction between the contact pad 40 and the contact pad 42 when the upper portion 18 is forced against the lower portion 16.

In order to provide variations in the potential drop between the first conductor 36 and the second conductor 38 in response to variations in the pressure with which the upper portion 18 is pressed into contact against the lower portion 16, a first semiconducting composition layer 46 is disposed by spraying or the like to cover the first conductor 36 including the circular contact pad 40. Similarly, although not essentially, a semiconducting composition layer 48 is also disposed by spraying or the like to cover the second conductor 38 particularly including the contact pad 42.

In the preferred embodiment the semiconductor composition is a mixture of molybdenum disulphide, a resin and possibly powdered carbon which is thinned with a resin thinner to a sprayable consistency. Thus, a very thin layer of the semiconducting composition layer may be disposed on top of the first and second conductors.

Referring again to FIG. 1, the flexible base member which may be made out of a thin (preferably in the range of ½ to 5 mils) Mylar is folded into a sandwich-like configuration with the donut-shaped spacer 20 therebetween. An adhesive material is then disposed on the top and bottom surface of the spacer 20 with the lower portion 16 and the upper portion 18 being held with the semiconducting composition covered contact pads 40 and 42 in facing but spaced apart relationship. The bottom surface 28 of the lower portion 16 of the flexible base is also adhesively affixed to the top surface 50 of the rigid base member 12. Thus, the lower portion 16 of the flexible base 14 is maintained in a rigid state by the rigid base 12 while the upper portion 18 of the flexible base 14 is transversely movable into contacting relationship with the lower portion 16.

In the embodiment shown in FIGS. 1 and 2, the spacer 20 is positioned to adhesively connect the lower portion 16 and the upper portion 18 of the flexible base 14 about the entire periphery or at least a substantial portion of the periphery of the two portions 16 and 18. In one embodiment, the spacer may be simply double stick tape cut in the appropriate shape.

If the spacer 20 is positioned to adhesively connect the lower portion 16 and the upper portion 18 of the flexible base 14 about the entire periphery, it may be necessary to provide a breathing hole 29 between the chamber defined by the spacer 20 and the region outside the transducer 10. It will be appreciated that the moisture which it is desired to prevent from entering the chamber defined by the spacer 20 exists on the side of the diaphragm 24 against which variations in pressure are applied. Since the breathing hole 29 exits from the opposite side, the undesired moisture is still prevented from entering the chamber defined by the spacer 20.

The resiliently deformable diaphragm 24 is next adhesively attached to the top surface of the diaphragm spacer 22 which is adhesively attached to the upper portion 18 of the flexible base member. The spacer 22 may be a square or rectangular cross section toroidal or donut-shaped member and may also be cut from double stick tape. Consequently, the peripheral edges of the resiliently deformable diaphragm 24 are in spaced relationship to the upper portion 18 of the flexible base member 14. However, in order to assure that the upper portion 18 of is continuously responsive to both increasing and decreasing pressure forces, a central region of the resiliently deformable diaphragm 24 laterally spaced from the edges of the diaphragm spacer 22 is adhesively attached to the top of the upper portion 18 of the flexible base member 14. Thus, when an increased pressure is exerted against the diaphragm 24, the upper portion 18 will be pressed downwardly until the semiconducting composition covered contact pad 42 is in electrically conducting relationship with the semiconducting composition covered contact pad 40. The greater the force exerted against the upper portion 18 the less the contact resistance will be between the upper and lower contact pads 42 and 40 and hence the smaller the potential drop across the first and second conductors 36 and 38. As the pressure force decreases, the inherent resiliency of the diaphragm 24 which may, for example, be made out of stretchable rubber such as dam rubber, will pull the upper portion 18 in a direction away from the lower portion 16 to thereby increase the contact resistance between the lower contact pad 40 and the upper contact pad 42 until the force exerted against the diaphragm 24 is sufficiently small that contact between the upper and lower contact pads 40 and 42 is broken and resistance becomes infinite.

In the preferred embodiment the resilient deformable diaphragm 24 is adhesively held across the top of the diaphragm spacer 22 by the retaining ring 26 which is also adhesively attached around the periphery of the diaphragm 24 so that the diaphragm 24 is held in a taut or flat configuration between the retaining ring 26 and the diaphragm spacer 22.

Figure 3:
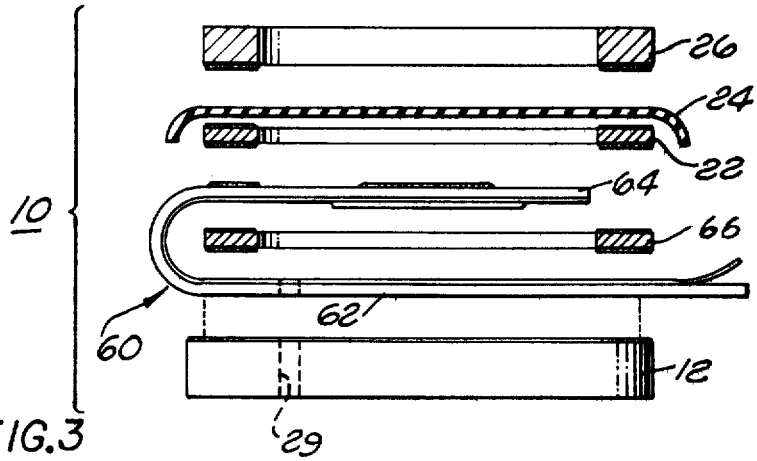
FIG. 3 is an exploded cross-sectional side plan view of a second embodiment of the invention wherein the top of the flexible base constitutes a flap disposed to move transversely about a hinge portion.
Figure 4:
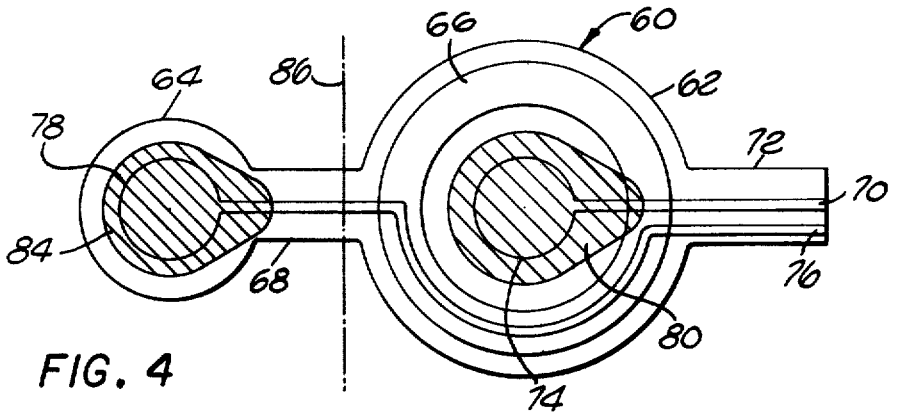
FIG. 4 is a top plan view of the flexible base used in FIG. 3 in an unfolded configuration illustrating the conductor patterns disposed thereon.

Referring to FIGS. 3 and 4, an alternative embodiment of the present invention is illustrated comprising a rigid base 12 an alternative flexible base structure 60, a diaphragm spacer 22, a diaphragm 24 and a rigid retaining member 26. As in the first embodiment, the bottom surface of a lower portion 62 of the flexible base member 60 is adhesively attached to the rigid base 12. In addition, the spacer 22 adhesively attaches the diaphragm 24 to the flexible base member 60. A central region of the diaphragm 24 is then adhesively attached to an upper or flap portion 64 of the flexible base member 60.

Referring to FIG. 4, the flexible base member 60 has a first generally circular shaped lower portion 62 interconnected by a hinge or bridge portion 68 to the generally circular flap portion 64 which is smaller in diameter than the lower portion 62. A spacer 66 is adhesively attached around the periphery of the lower portion 62. The spacer 66 is generally a square or rectangular cross section toroidal spacer with a central space having an area which is larger than the surface area of the flap portion 64. Thus, when the flap portion 64 is folded to overlay the lower portion, 62, it will be unattached about its periphery except at the hinged portion 68. Thus, the flap portion 64 is freely transversely movable about the hinge portion 68 in the region surrounded by the spacer 66.

In a manner similar to that previously described in conjunction with FIG. 2, a first conductor 70 extends from a connector portion 72 and forms a centrally located contact pad 74 in the first portion 62 of the flexible base 60. A second conductor 76 disposed on the base 60 also extends from the connector portion 72 but extends in a path around the periphery of the first portion 62 across the hinge or bridge portion 68 and forms a contact pad 78 positioned centrally in the flap portion 64. A suitable semiconducting composition layer 80 is disposed to cover at least the contact pad 74 and optionally the contact 78. The conductor pads 74 and 78 are positioned symmetrically on opposite sides of the fold line 86 so that when the flap portion 64 is folded over along the fold line 86 the contact pad 78 will be aligned in facing relationship with the contact pad 74.

To provide positive movement of the flap portion 64, both toward and away from the lower portion 62 of the flexible base in response to increases and decreases in the applied air pressure, the top surface of the flap 64 opposite the surface on which the contact pad 78 is disposed is adhesively attached to the lower surface of the diaphragm at a central location of the diaphragm laterally spaced from the inside peripheral edge of the diaphragm spacer 22. Thus, the flap portion 64 moves as the resiliently deformable diaphragm 24 moves to thereby cause variations in the contact resistance between the contact pad 74 and the contact pad 78 in response to variations in pressure applied against the diaphragm 24.

Figure 5:
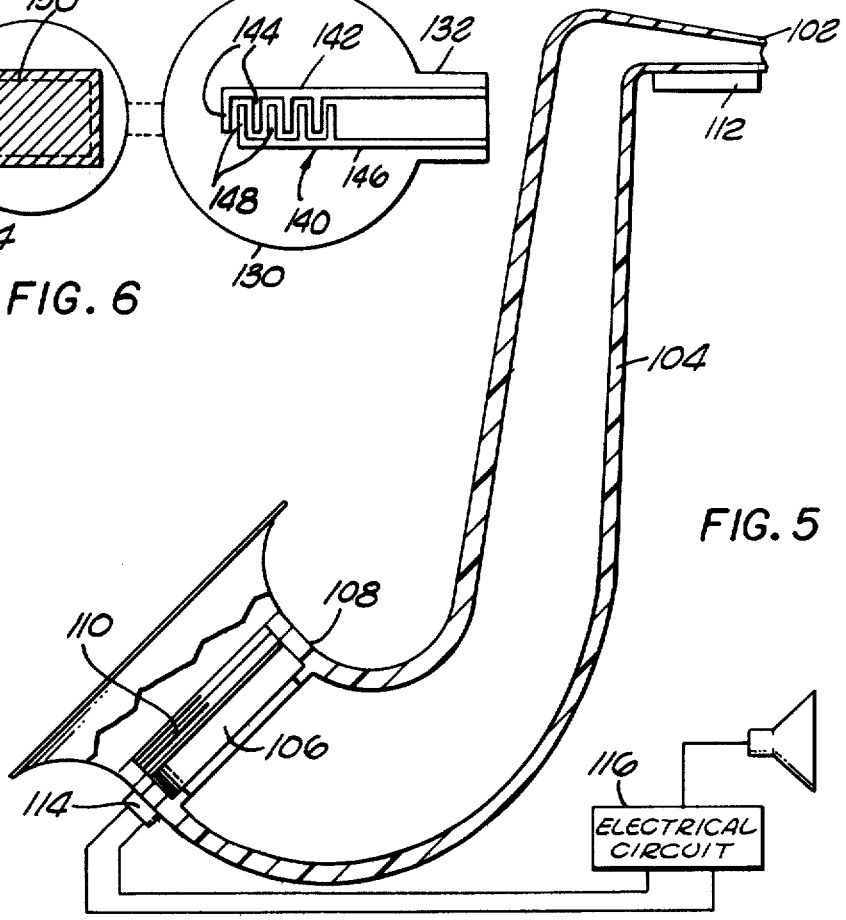
FIG. 5 is a simplified partial cross-section and partial schematic view of a musical instrument incorporating a pressure transducer as illustrated in FIGS. 1 or 3.

The pressure transducer in acordance with the present invention may be utilized in any number of devices. However, one particularly advantageous use is in an electronic saxophone-like device 100, such as the one illustrated in FIG. 5 which has a mouthpiece 102, an air chamber 104, and a pressure transducer 106 in accordance with the invention disposed in the end of the chamber 104 with the diaphragm facing inwardly toward the chamber 104. A plug 110 is inserted or otherwise sealed in position in the orifice end 108 of the saxophone-like device to rigidly hold the pressure transducer 106 in position. An additional pressure transducer device 112 may also be positioned at the mouthpiece to be pressed with the lips. A connector 114 is interconnected to the connector 28 or 72 (FIGS. 2 and 4, respectively) or to connector 132 in FIG. 6 to be described hereafter, of the selected pressure transducer in accordance with the invention. An appropriate electronic tone generating circuit 116 is interconnected to the connector 114 so that, for example, the volume of the tone generated by the tone generating circuit 116 can be varied in response to variation of air pressure in the chamber 104. Thus, the harder a user blows into the mouthpiece 102 the greater the pressure in the chamber 104 and the higher the volume generated.

Figure 6:
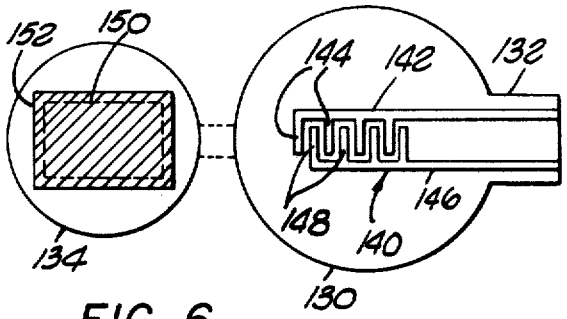
FIG. 6 is a top plan view of the flexible base used in FIG. 3 in an unfolded configuration illustrating another conductor configuration.

Referring to FIG. 6, an alternative pressure transducer in accordance with the invention is illustrated. Specifically, the pressure transducer incorporates a first support member 130 which may be flexible or rigid (e.g., a PC board), a second support member 134, and a connector portion 132 extending from the first support member 130. A spacer (not shown) is adhesively attached around the periphery of the first support member in a manner similar to that previously described in conjunction with FIG. 4.

Of course, while the first support member 130 and the second support member 134 are shown as separate members, they may be a single member connected by a hinge portion as in FIGS. 2 and 4 in which case the second upper member adhesively attached to the diaphragm pivots about the hinge portion as the diaphragm moves in and out. However, because the second support member provides only a shunt support there is no need to provide a conductive link across the hinge in this embodiment as will be subsequently described. Hence, the second support member 134 may be detached from the first support member 130 and the second support member 134 simply adhesively attached to the diaphragm so that the second support member 134 moves with the diaphragm. A particularly convenient method of accomplishing this is to spray or silk-screen semiconducting material onto the surface of Packlon Tape which is a printable tape produced by 3M Corporation. A circular dot of this semiconductor covered tape is then stuck onto the diaphragm facing the first support member 130.

To provide a transducer device according to this shunt embodiment, a first conductor 140 is disposed on the surface of the first support member 130 where the first conductor 140 includes a first contact member 142 with a plurality of interdigiting fingers 144 and a second contact member 146 also with a plurality of interdigiting fingers 148. The interdigiting fingers 144 and 148 are interleaved between one another in an electrically isolated relationship.

A second conductor 150 is disposed on the surface of the second support member 134 so that when the second support member 134 is adhesively fixed to the diaphragm, the second conductor portion 150 will be juxtaposed in transverse alignment with the first conductor 140.

Prior to affixing the second support member to the diaphragm, a semiconducting composition layer 152 is disposed to overlay the second conductor 150 to thereby provide a contact resistance between the first and second conductors 140 and 150 when those two conductors are depressed into electrically conducting relationship with one another by the movement of the diaphragm. Of course, it will be appreciated that the semiconducting composition layer may be disposed on either the first or the second conductors 140 or 150, respectively, or alternatively, the second conductor 150 may be made entirely from the semiconducting composition material with a separate conductor such as silver or copper eliminated. Of course, if the semiconducting layer is disposed on the first and second contact members, it is preferable that there be a laterally disposed insulating space between the semiconducting material on the two contact members. It will also be appreciated that the particular interdigiting fingers may be of any shape and may, for example, be disposed on the surface in a circular arrangement. Thus, in this embodiment the second conductor portion acts as a shunt between the first and second contact members.

It will be appreciated that the spacers are preferably the thickness of a piece of commercially available stick tape and that the Mylar, in the preferred embodiment, is about 3 mils thick. The contact pads may be of any suitable size and shape and may for example be circular with a diameter of about $\frac{1}{4}$-$\frac{1}{2}$ inches. Finally, in the aforedescribed embodiment where the spot of semiconductor tape is stuck to the surface of the diaphragm, only one of the spacers 20 and 22 is required (FIGS. 1 or 3).

Of course it will be understood by those skilled in the art that the foregoing and other changes in form and details may be made without departing from the spirit and scope of the invention.

What is claimed is:

1. A pressure transducer device comprising:

a housing defining a chamber with a bottom surface and side walls;

a first conductor positioned adjacent the bottom surface of the chamber;

a flap having an upper and lower surface generally parallel with the bottom surface and a hinge region for movably attaching the flap at a spaced location above the bottom surface to extend from a side wall into the chamber, the flap being movable in the chamber about the hinge region;

a second conductor disposed on the lower surface of the flap;

a pressure responsive semiconducting composition layer disposed for covering at least one of the first conductor and the second conductor; and a diaphragm attached about its periphery to the housing in spaced relationship to the bottom surface for enclosing the chamber, the diaphragm adhesively attached to the upper surface of the flap at a center region laterally spaced from the housing, the second conductor being variably movable with the flap into electrically conducting relationship with the first conductor by the diaphragm in response to variations in pressure force exerted against the diaphragm.

2. The pressure transducer device of claim 1 wherein the first conductor comprises:

a first contact member; and a second contact member, the first and second contact members being electrically isolated with the second conductor providing a shunt for electrically coupling the first and second contact members in response to the application of the single transverse force.

3. The pressure transducer device of claim 2 wherein the first and second contact members each have a plurality of interdigiting fingers.

4. The pressure transducer device of claims 2 or 3 wherein the second conductor comprises the pressure responsive semiconducting composition layer.

5. The pressure transducer device of claims 2 or 3 wherein the pressure responsive semiconducting composition layer is disposed for separately overlying, in electrically isolated relationship, each of the first and second contact members for providing a contact resistor thereon.

6. The pressure transducer device of claim 1 further comprising a retainer member fixed about the periphery of the diaphragm for holding the peripheral edges of the diaphragm against the housing.

7. The pressure transducer device of claim 1 further comprising a rigid base member for maintaining the bottom surface of the chamber rigid in response to variations in pressure.

8. A pressure transducer device comprising:

a first member;

a first conductive contact disposed on the first member;

a second member;

a second conductive contact disposed on the second member, the second conductive contact being normally spaced from the first conductive contact for being movable into electrically conducting relationship with the first conductive contact;

pressure responsive semiconducting composition covering at least one of the first and second conductive contacts on the first and second members for providing a variable contact resistance between the first and second conductive contacts;

a diaphragm resiliently and variably movable in response to variations in pressure exerted thereagainst, the diaphragm attached about its periphery to the second member in spaced relationship thereto and attached at a center region to the second member whereby the second conductive contact is movable with the diaphragm into electrically conducting relationship with the first conductive contact.

9. A pressure transducer device comprising:

a base structure;

a first conductor fixed to the base structure;

a first spacer fixed to the base structure for extending around the first conductor;

a flap having a hinged portion attached to the first spacer in spaced relationship to the first conductor, the flap having an upper and a lower surface;

a second conductor disposed on the bottom surface of the flap facing the first conductor, the second conductor being transversely movable with the flap into contacting relationship with the first conductor;

a pressure responsive semiconducting composition layer disposed for covering at least one of the first and the second conductors;

a second spacer fixed to the first spacer with said hinge portion held between the first spacer and the second spacer so that the flap is movable relative to the first and second spacers about the hinge portion;

a diaphragm fixed about its periphery to the periphery of the second spacer over the central space of the second spacer for defining an enclosed chamber with the flap therein, the upper surface of the flap being adhesively attached to the diaphragm at a center region thereof which is laterally spaced from the second spacer, the second conductor being movable with the flap into electrically conducting relationship with the first conductor by the diaphragm in response to a pressure force exerted against the diaphragm.

10. A pressure transducer device comprising:

a rigid base member;

a flexible base member foldable to define an upper portion having a top and a bottom surface, and a lower portion, the lower portion being fixed to the rigid base member;

a first conductor disposed on the flexible base member at a first location on the lower portion;

a second conductor disposed on the flexible base member at a second location on the bottom surface of the upper portion;

a semiconducting composition layer disposed to cover at least one of the first and second conductors, the flexible base member folded for positioning the second conductor to face the first conductor;

a first spacer fixed to the flexible base member for spacing the upper portion of the flexible base member from the lower portion of the flexible base member, the upper portion being movable into contacting relationship with the lower portion;

a second spacer fixed to the top surface of the upper portion of the flexible base about the periphery thereof; and a diaphragm fixed about its periphery to the second spacer at a location transversely spaced from the upper portion of the flexible base, the diaphragm being attached to the top surface of the upper portion of the flexible base at a central location laterally spaced from the second spacer.

11. A pressure transducer device comprising:

a house defining a chamber with a bottom surface and side walls;

a first conductor positioned adjacent the bottom surface of the chamber;

a diaphragm attached about its periphery to the housing in spaced relationship to the bottom surface for enclosing the chamber;

a first support member adhesively attached to the diaphragm at a center region thereof laterally spaced from the housing;

a second conductor disposed on the first support member, the second conductor being variably movable with the first support member into electrically conducting relationship with the first conductor by the diaphragm in response to variations in pressure force exerted against the diaphragm; and a pressure responsive semiconducting composition layer disposed for covering at least one of the first conductor and the second conductor.

12. The pressure transducer device of claim 11 wherein the first conductor comprises:

a first contact member; and a second contact member, the first and second contact members being electrically isolated with the second conductor providing a shunt for electrically coupling the first and second contact members in response to the application of the single transverse force.

13. The pressure transducer device of claim 12 wherein the first and second contact members each have a plurality of interdigiting fingers.

14. The pressure transducer device of claims 12 and 13 wherein the second conductor comprises the pressure responsive semiconducting composition layer.

15. The pressure transducer device of claims 12 or 13 wherein the pressure responsive semiconducting composition layer is disposed for separately overlying, in electrically isolated relationship, each of the first and second contact members for providing a contact resistor thereon.

16. The pressure transducer device of claim 11 wherein the chamber has a breathing hole therethrough.

* * * * *